US010746460B2

(12) United States Patent
Dorus

(10) Patent No.: US 10,746,460 B2
(45) Date of Patent: Aug. 18, 2020

(54) BEVERAGE COOLING ASSEMBLY

(71) Applicant: Robert Dorus, Stamford, CT (US)

(72) Inventor: Robert Dorus, Stamford, CT (US)

( * ) Notice: Subject to any disclaimer, the term of this patent is extended or adjusted under 35 U.S.C. 154(b) by 256 days.

(21) Appl. No.: 16/009,359

(22) Filed: Jun. 15, 2018

(65) Prior Publication Data

US 2019/0383555 A1 Dec. 19, 2019

(51) Int. Cl.
*F25D 31/00* (2006.01)
*F28F 3/02* (2006.01)

(52) U.S. Cl.
CPC ..... *F25D 31/007* (2013.01); *F28F 3/022* (2013.01); *F25D 2331/803* (2013.01); *F25D 2331/805* (2013.01)

(58) Field of Classification Search
CPC .... F25D 31/007; F25D 19/006; F25D 19/003; F25D 2331/803; F25D 2331/805; F25D 3/107; F25D 2400/12; F25D 11/00; F25D 2331/809; F25D 2400/28; F25D 3/08; F25D 2303/0831; F25D 2303/0841; F25D 2303/0845; F25D 2303/0843; F28F 3/022; F28F 1/126
See application file for complete search history.

(56) References Cited

U.S. PATENT DOCUMENTS 2,596,037 A * 5/1952 Maniscalco ..... F25D 11/00 62/449
2,736,174 A 2/1956 Tice
3,432,641 A * 3/1969 Welke ..... A47J 36/2433 219/433
3,555,848 A * 1/1971 Johnson ..... F25B 1/005 62/457.9
4,801,782 A * 1/1989 Ineson ..... A47J 36/2466 219/438
4,815,287 A * 3/1989 O'Daniel ..... F25D 3/08 62/430
4,825,665 A * 5/1989 Micallef ..... F25D 3/06 62/372
5,181,393 A * 1/1993 Lott ..... A61L 11/00 62/264
5,372,017 A * 12/1994 Zorea ..... F25B 5/02 62/293
5,377,495 A * 1/1995 Daigle ..... F25B 45/00 165/46
5,780,819 A * 7/1998 Fabrikant ..... A45D 27/00 219/432

(Continued)

*Primary Examiner* — Frantz F Jules
*Assistant Examiner* — Martha Tadesse

(57) ABSTRACT

A beverage cooling assembly for rapidly cooling a beverage container includes a cylinder for insertably receiving a beverage container. A base is rotatably coupled to the cylinder and a cooling unit is positioned within the base. A plurality of bristles is provided and each of the bristles is coupled to and extends inwardly on the cylinder. Each of the bristles is comprised of a thermally conductive material and each of the bristles is in thermal communication with the cooling unit such that the cooling unit cools the bristles when the cooling unit is turned on. Moreover, each of the bristles frictionally engages the beverage container when the beverage container is positioned in the cylinder. In this way the cooling unit cools the beverage container when the beverage container is positioned in the cylinder.

8 Claims, 5 Drawing Sheets

(56) References Cited

U.S. PATENT DOCUMENTS

| | | | | |
|---|---|---|---|---|
| 5,845,501 | A * | 12/1998 | Stonehouse | A23L 3/003 62/62 |
| 5,966,964 | A | 10/1999 | Pattee | |
| 6,072,161 | A * | 6/2000 | Stein | A47G 19/2288 219/386 |
| 6,310,329 | B1 * | 10/2001 | Carter | A47G 19/2288 219/430 |
| 6,314,867 | B1 * | 11/2001 | Russell | A47J 36/2466 219/432 |
| 6,397,624 | B1 | 6/2002 | Horwell | |
| 6,674,052 | B1 * | 1/2004 | Luo | A47J 41/0077 219/432 |
| 6,861,618 | B2 * | 3/2005 | Binet | A47J 36/2438 219/401 |
| 7,146,826 | B1 * | 12/2006 | Schlosser | F25D 31/007 62/457.9 |
| 7,347,055 | B2 * | 3/2008 | Lucas | F25D 31/007 62/457.4 |
| 7,972,063 | B1 * | 7/2011 | Barsalou | B65D 81/3883 206/522 |
| D786,025 | S | 5/2017 | Seiders | |
| 2009/0038317 | A1 * | 2/2009 | Otey | F25B 21/04 62/3.2 |
| 2011/0005260 | A1 * | 1/2011 | Ferguson | F25D 31/007 62/331 |
| 2012/0247128 | A1 * | 10/2012 | Henry | F25D 5/02 62/4 |
| 2015/0233631 | A1 | 8/2015 | Shuntich | |
| 2016/0037947 | A1 | 2/2016 | Goetz | |
| 2016/0209112 | A1 * | 7/2016 | Bayless | F25D 31/007 |
| 2019/0075951 | A1 * | 3/2019 | Torilli | F25D 31/007 |
| 2019/0331412 | A1 * | 10/2019 | Oliver | F25D 3/02 |
| 2019/0344697 | A1 * | 11/2019 | Stefos | A47J 36/2483 |

* cited by examiner

BEVERAGE COOLING ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to cooling devices and more particularly pertains to a new cooling device for rapidly cooling a beverage container.

BRIEF SUMMARY OF THE INVENTION

An embodiment of the disclosure meets the needs presented above by generally comprising a cylinder for insertably receiving a beverage container. A base is rotatably coupled to the cylinder and a cooling unit is positioned within the base. A plurality of bristles is provided and each of the bristles is coupled to and extends inwardly on the cylinder. Each of the bristles is comprised of a thermally conductive material and each of the bristles is in thermal communication with the cooling unit such that the cooling unit cools the bristles when the cooling unit is turned on. Moreover, each of the bristles frictionally engages the beverage container when the beverage container is positioned in the cylinder. In this way the cooling unit cools the beverage container when the beverage container is positioned in the cylinder.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
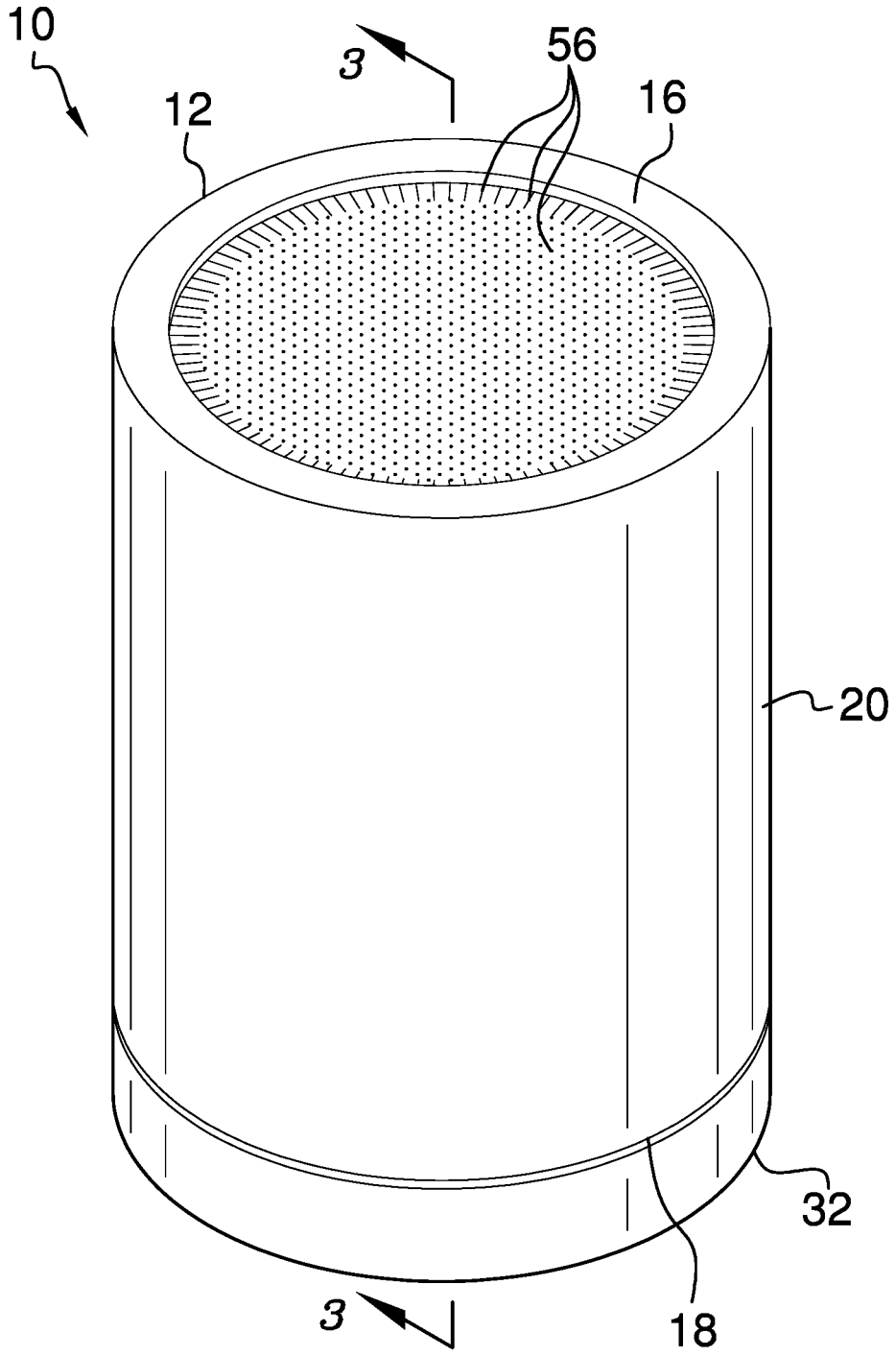
FIG. 1 is a top perspective view of a beverage cooling assembly according to an embodiment of the disclosure.
Figure 2:
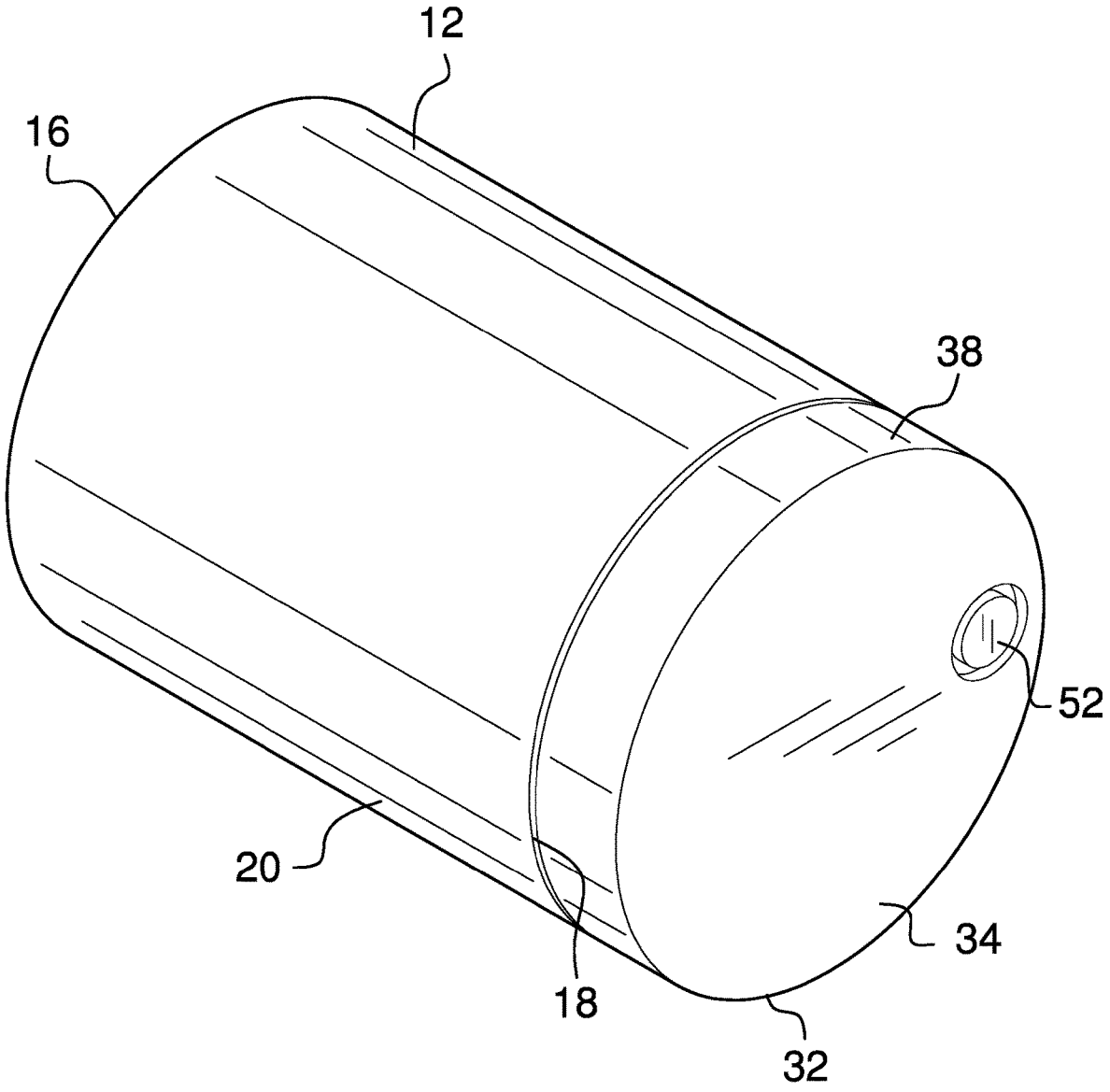
FIG. 2 is a bottom perspective view of an embodiment of the disclosure.
Figure 3:
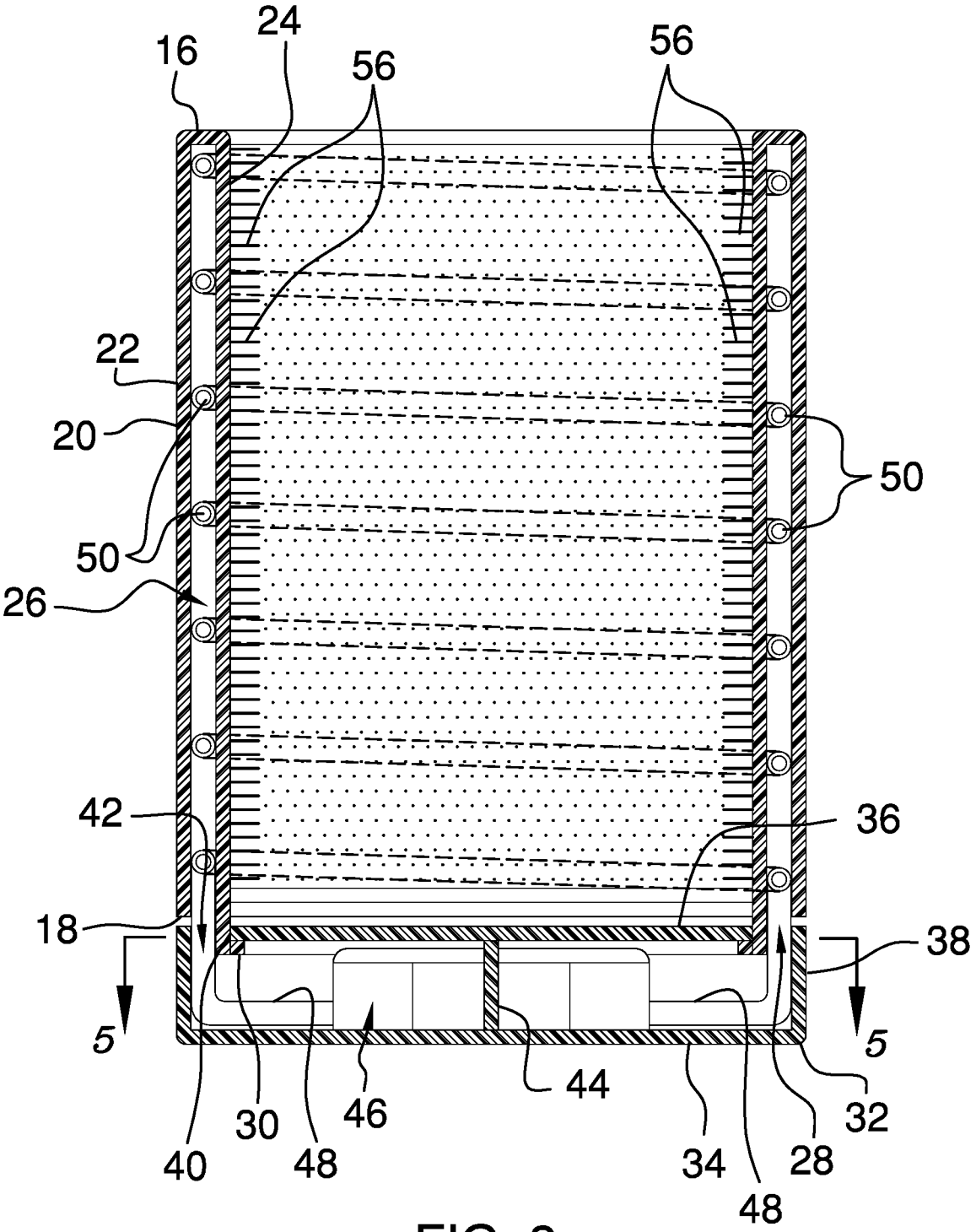
FIG. 3 is a cross sectional view taken along line 3-3 of FIG. 1 of an embodiment of the disclosure.
Figure 4:
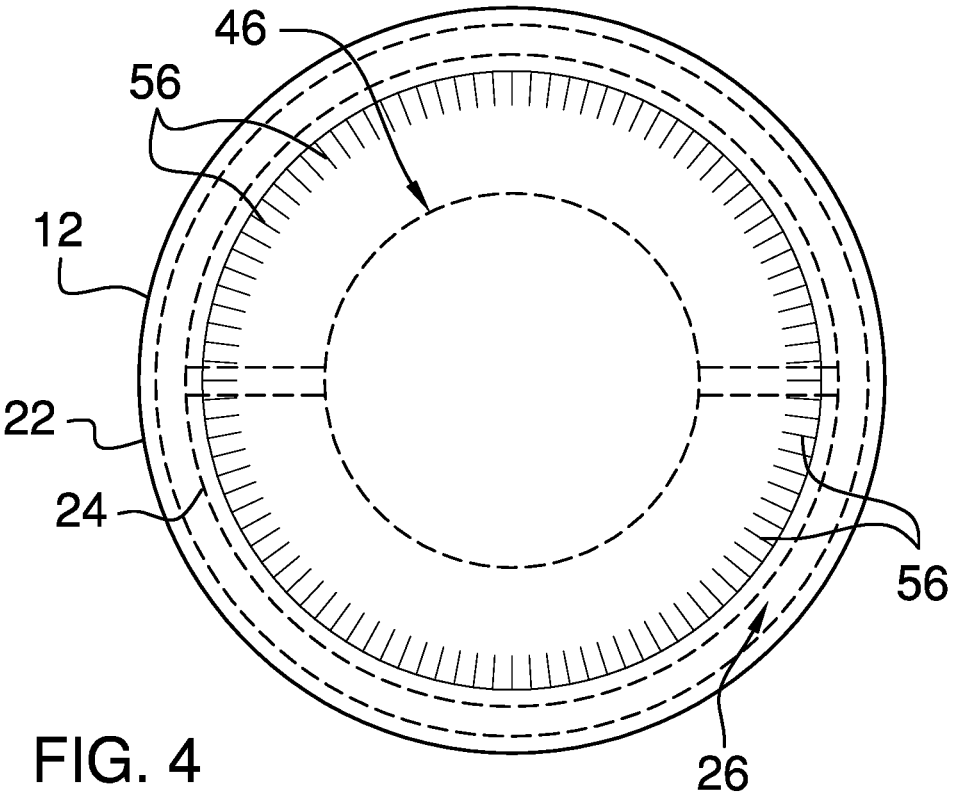
FIG. 4 is a top phantom view of an embodiment of the disclosure.
Figure 5:
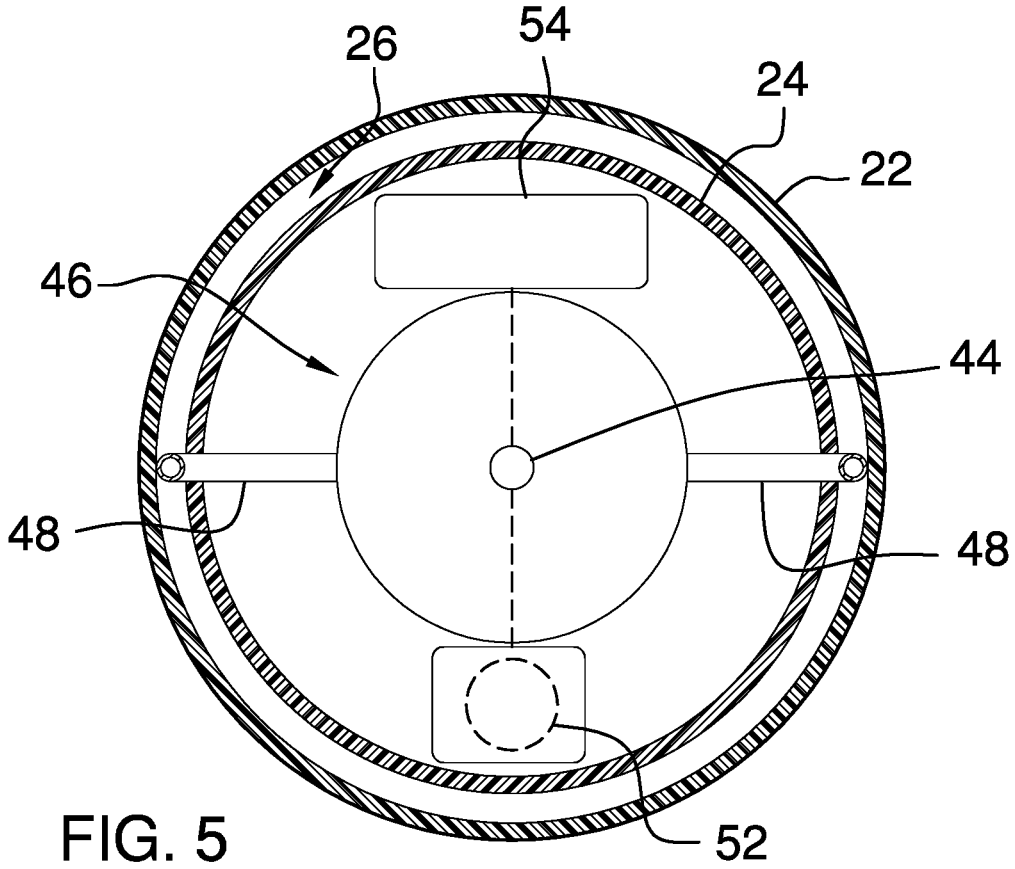
FIG. 5 is a cross sectional view taken along line 5-5 of FIG. 3 of an embodiment of the disclosure.
Figure 6:
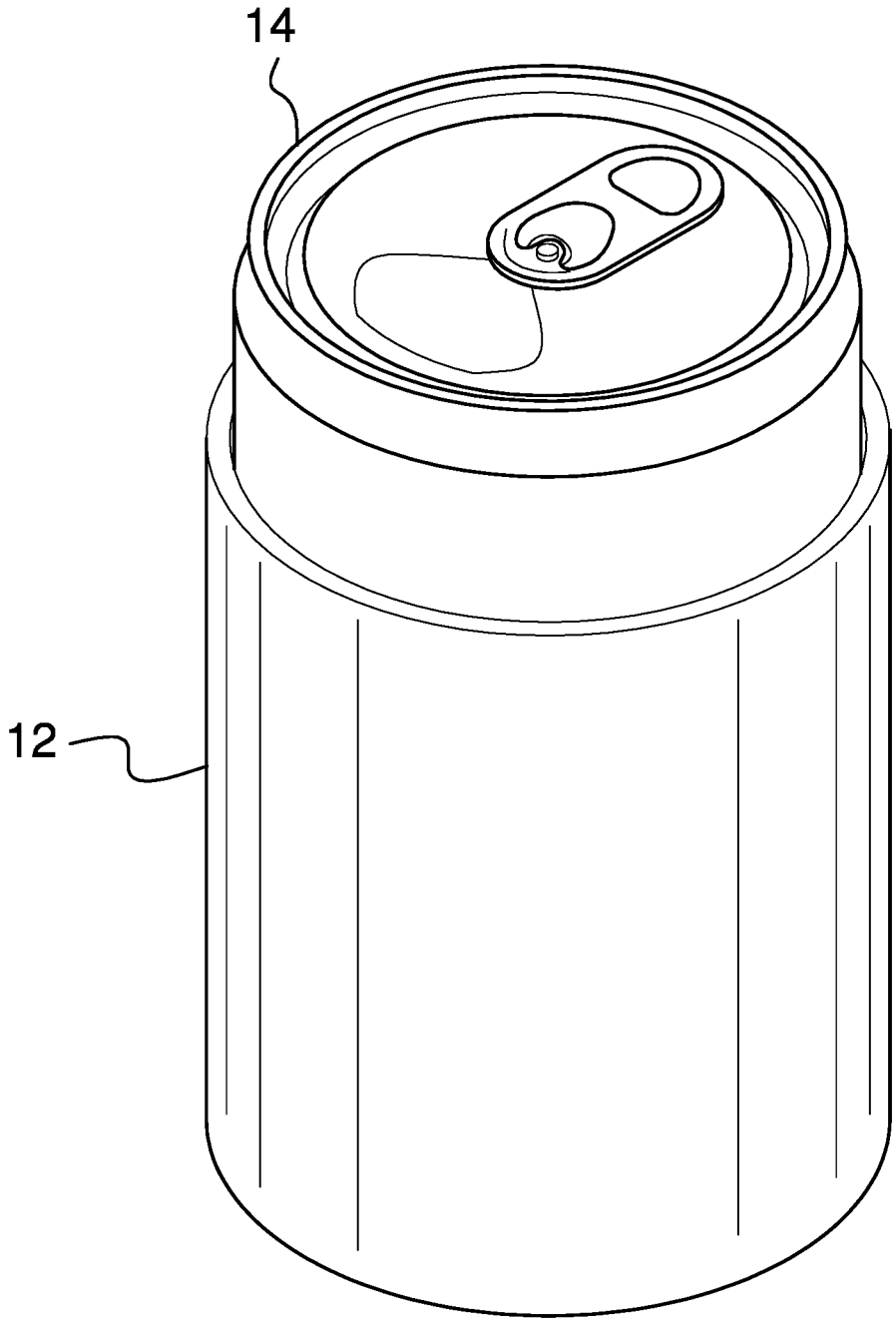
FIG. 6 is a perspective in-use view of an embodiment of the disclosure.

With reference now to the drawings, and in particular to FIGS. 1 through 6 thereof, a new cooling device embodying the principles and concepts of an embodiment of the disclosure and generally designated by the reference numeral 10 will be described.

As best illustrated in FIGS. 1 through 6, the beverage cooling assembly 10 generally comprises a cylinder 12 for insertably receiving a beverage container 14. The beverage container 14 may be an aluminum can, a glass bottle and any other thermally conductive beverage container 14. The cylinder 12 has a top end 16, a bottom end 18 and an outer wall 20 extending therebetween, and each of the top end 16 and the bottom end 18 is open. The outer wall 20 has an outer portion 22 and an inner portion 24, and the inner portion 24 is rotatably coupled to the outer portion 22. The inner portion 24 may be rotatably retained on the outer portion 22 with a track, a bearing and any other mechanical means of rotatably retaining the inner portion 24 on the outer portion 22.

The outer wall 20 has a tube chamber 26 that is positioned between the outer 22 and inner 24 portions. The tube chamber 26 extends from the top end 16 through the bottom end 18 to define a tube opening 28 in the bottom end 18 of the outer wall 20. Moreover, the tube chamber 26 extends around a full circumference of the outer wall 20. The outer portion 22 is comprised of a thermally insulating material and the inner portion 24 is comprised of a thermally conductive material.

A lip 30 is coupled to and extends inwardly from the inner portion 24 of the outer wall 20. The lip 30 is aligned with the bottom end 18 and the lip 30 extends around the full circumference of the inner portion 24. A base 32 is rotatably coupled to the cylinder 12 and the base 32 is hollow. The base 32 is positioned on the bottom end 18 of the cylinder 12 thereby closing the bottom end 18. Additionally, the base 32 is coupled to the inner portion 24 of the outer wall 20 of the cylinder 12 such that the inner portion 24 rotates with the base 32 when the base 32 is rotated.

The base 32 has a lower wall 34, an upper wall 36 and a perimeter wall 38 extending therebetween, and the perimeter wall 38 is continuously arcuate such that the base 32 has a puck shape. The upper wall 36 has an outside edge 40 that is spaced from and is coextensive with the perimeter wall 38 to define an opening 42 in the base 32. The opening 42 is positioned between the upper wall 36 and the perimeter wall 38. The upper wall 36 engages the lip 30 such that the base 32 is rotatably retained on the cylinder 12. A stem 44 is coupled between the lower wall 34 and the upper wall 36 of the base 32 and the stem 44 is centrally positioned in the base 32. Thus, the stem 44 suspends the lower wall 34 from the upper wall 36.

A cooling unit 46 is positioned within the base 32 and the cooling unit 46 contains a gaseous refrigerant. The cooling unit 46 may include an electric condenser, an electric compressor and any other components common to cooling units that employ pressurized, gaseous refrigerants. Additionally, the gaseous refrigerant may be Freon or other gaseous refrigerants common to electrical refrigeration units. The cooling unit 46 includes a plurality of first tubes 48 and each of the first tubes 48 is in fluid communication with the cooling unit 46 for receiving the gaseous refrigerant. Each of the first tubes 48 extends upwardly through the opening in the base 32, upwardly through the tube opening 28 in the bottom end 18 of the cylinder 12 and upwardly in the tube chamber 26 in the cylinder 12. Each of the first tubes 48 is comprised of a thermally conductive material.

The cooling unit 46 includes a plurality of second tubes 50 and each of the second tubes 50 is positioned in the chamber. Each of the second tubes 50 is horizontally oriented in the chamber and each of the second tubes 50 is continuous such that each of the second tubes 50 forms a closed loop. The second tubes 50 are spaced apart from each other and are distributed between the top end 16 and the bottom end 18 of the cylinder 12. Each of the second tubes 50 is comprised of a thermally conductive material. Each of the second tubes 50 is in fluid communication with each of the first tubes 48 such that each of the second tubes 50 receives the gaseous refrigerant. Moreover, each of the second tubes 50 is in thermal communication with the inner portion 24 of the outer wall 20 of the cylinder 12 such that the gaseous refrigerant cools the inner portion 24 when the cooling unit 46 is turned on.

A power button 52 is movably coupled to the base 32 and the power button 52 is electrically coupled to the cooling unit 46 to turn the cooling unit 46 on and off. A power supply 54 is positioned within the base 32, the power supply 54 is electrically coupled to the cooling unit 46 and the power supply 54 comprises at least one battery. The cooling unit 46 may include an electronic timer and a time button may be movably coupled to the base 32. The time button may be electrically coupled to the electronic timer for selecting one of a plurality of pre-determined durations of operation time with respect to the cooling unit 46.

A plurality of bristles 56 is each coupled to and extends inwardly on the cylinder 12 and each of the bristles 56 is comprised of a thermally conductive material. Moreover, each of the bristles 56 is in thermal communication with the cooling unit 46 such that the cooling unit 46 cools the bristles 56 when the cooling unit 46 is turned on. Each of the bristles 56 frictionally engages the beverage container 14 when the beverage container 14 is positioned in the cylinder 12. Thus, the cooling unit 46 is in thermal communication with the beverage container 14 for cooling the beverage container 14.

Each of the bristles 56 is positioned on the inner portion 24 of the outer wall 20 of the cylinder 12. The bristles 56 are spaced apart from each other and are distributed on the inner portion 24. Additionally, each of the bristles 56 is in thermal communication with the inner portion 24 such that the inner portion 24 cools the bristles 56 when the cooling unit 46 is turned on. Each of the bristles 56 may be comprised of a bendable material thereby facilitating the bristles 56 to accommodate beverage containers 14 of varying diameters.

In use, the beverage container 14 is inserted into the cylinder 12 for rapidly cooling the beverage container 14. In this way the beverage in the beverage container 14 can be cooled below the temperature at which the beverage container 14 was previously stored. The power button 52 is manipulated to turn the cooling unit 46 on and the cooling unit 46 cools the bristles 56. Thus, the bristles 56 cool the beverage container 14. The base 32 is rotated while the cylinder 12 is gripped thereby rotating the bristles 56 around the beverage container 14 and enhancing thermal communication between the bristles 56 and the beverage container 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. Bayless discloses a beverage cooling assembly being configured to cool a beverage container, the assembly comprising:

a cylinder for insertably receiving the beverage container;

a base being rotatably coupled to the cylinder;

a cooling unit being positioned within the base, the cooling unit containing a gaseous refrigerant; and a plurality of bristles, each of the bristles being coupled to and extending inwardly on the cylinder, each of the bristles being comprised of a thermally conductive material, each of the bristles being in thermal communication with the cooling unit such that the cooling unit cools the bristles when the cooling unit is turned on, each of the bristles frictionally engaging the beverage container when the beverage container is positioned in the cylinder wherein the cooling unit is configured to cool the beverage container;

a power button being movably coupled to the base, the power button being electrically coupled to the cooling unit to turn the cooling unit on and off; and a power supply being positioned within the base, the power supply being electrically coupled to the cooling unit, the power supply comprising at least one battery.

2. The assembly according to claim 1, wherein:

the cylinder has a top end, a bottom end and an outer wall extending therebetween, each of the top end and the bottom end being open, the outer wall having an outer portion and an inner portion, the inner portion being rotatably coupled to said outer portion;

the outer wall having a tube chamber being positioned between the outer and inner portions, the tube chamber extending from the top end through the bottom end to define a tube opening in the bottom end of the outer wall, the tube chamber extending around a full circumference of the outer wall;

the outer portion being comprised of a thermally insulating material; and the inner portion being comprised of a thermally conductive material.

3. The assembly according to claim 2, further comprising:

a lip being coupled to and extending inwardly from the inner portion of the outer wall, the lip being aligned with the bottom end, the lip extending around the full circumference of the outer wall; and the base being coupled to the inner portion of the outer wall of the cylinder such that the inner portion rotates with the base when the base is rotated.

4. The assembly according to claim 3, wherein the base is hollow, the base being positioned on the bottom end of the cylinder thereby closing the bottom end, the base having a lower wall, an upper wall and a perimeter wall extending therebetween, the perimeter wall being arcuate such that the base has a puck shape, the upper wall having an outside edge being spaced from and being coextensive with the perimeter wall to define an opening in the base being positioned between the upper wall and the perimeter wall, the upper wall resting on the lip such that the base is rotatably retained on the cylinder.

5. The assembly according to claim 4, further comprising a stem being coupled between the lower wall and the upper wall of the base, the stem being centrally positioned in the base.

6. The assembly according to claim 4, wherein the cooling unit includes a plurality of first tubes, each of the first tubes being in fluid communication the cooling unit such that each of the first tubes receives the gaseous refrigerant, each of the first tubes extending upwardly through the opening in the base, upwardly through the tube opening in the bottom end of the cylinder and upwardly in the chamber in the cylinder.

7. The assembly according to claim 6, further comprising:

a plurality of second tubes, each of the second tubes being positioned in the chamber, each of the second tubes being horizontally oriented in the chamber, each of the second tubes being continuous such that each of the second tubes forms a closed loop, the second tubes being spaced apart from each other and being distributed between the top end and the bottom end of the cylinder, each of the second tubes being in fluid communication with each of the first tubes such that each of the second tubes receives the gaseous refrigerant; and each of the second tubes being in thermal communication with the inner portion of the outer wall of the cylinder such that the gaseous refrigerant cools the inner portion when the cooling unit is turned on.

8. A beverage cooling assembly being configured to cool a beverage container, the assembly comprising:

a cylinder for insertably receiving the beverage container, the cylinder having a top end, a bottom end and an outer wall extending therebetween, each of the top end and the bottom end being open, the outer wall having an outer portion and an inner portion, the inner portion being rotatably coupled to said outer portion, the outer wall having a tube chamber being positioned between the outer and inner portions, the tube chamber extending from the top end through the bottom end to define a tube opening in the bottom end of the outer wall, the tube chamber extending around a full circumference of the outer wall, the outer portion being comprised of a thermally insulating material, the inner portion being comprised of a thermally conductive material;

a lip being coupled to and extending inwardly from the inner portion of the outer wall, the lip being aligned with the bottom end, the lip extending around the full circumference of the outer wall;

a base being rotatably coupled to the cylinder, the base being hollow, the base being positioned on the bottom end of the cylinder thereby closing the bottom end, the base being coupled to the inner portion of the outer wall of the cylinder such that the inner portion rotates with the base when the base is rotated, the base having a lower wall, an upper wall and a perimeter wall extending therebetween, the perimeter wall being arcuate such that the base has a puck shape, the upper wall having an outside edge being spaced from and being coextensive with the perimeter wall to define an opening in the base being positioned between the upper wall and the perimeter wall, the upper wall resting on the lip such that the base is rotatably retained on the cylinder;

a stem being coupled between the lower wall and the upper wall of the base, the stem being centrally positioned in the base;

a cooling unit being positioned within the base, the cooling unit containing a gaseous refrigerant;

a plurality of first tubes, each of the first tubes being in fluid communication the cooling unit such that each of the first tubes receives the gaseous refrigerant, each of the first tubes extending upwardly through the opening in the base, upwardly through the tube opening in the bottom end of the cylinder and upwardly in the chamber in the cylinder;

a plurality of second tubes, each of the second tubes being positioned in the chamber, each of the second tubes being horizontally oriented in the chamber, each of the second tubes being continuous such that each of the second tubes forms a closed loop, the second tubes being spaced apart from each other and being distributed between the top end and the bottom end of the cylinder, each of the second tubes being in fluid communication with each of the first tubes such that each of the second tubes receives the gaseous refrigerant, each of the second tubes being in thermal communication with the inner portion of the outer wall of the cylinder such that the gaseous refrigerant cools the inner portion when the cooling unit is turned on;

a power button being movably coupled to the base, the power button being electrically coupled to the cooling unit to turn the cooling unit on and off;

a power supply being positioned within the base, the power supply being electrically coupled to the cooling unit, the power supply comprising at least one battery; and a plurality of bristles, each of the bristles being coupled to and extending inwardly on the cylinder, each of the bristles being comprised of a thermally conductive material, each of the bristles being in thermal communication with the cooling unit such that the cooling unit cools the bristles when the cooling unit is turned on, each of the bristles frictionally engaging the beverage container when the beverage container is positioned in the cylinder wherein the cooling unit is configured to cool the beverage container, each of the bristles being positioned on the inner portion of the outer wall of the cylinder, bristles being spaced apart from each other and being distributed on the inner portion, each of the bristles being in thermal communication with the inner portion such that the inner portion cools the bristles when the cooling unit is turned on.

* * * * *